US005971901A

United States Patent [19]

Shaw

[11] Patent Number: 5,971,901

[45] Date of Patent: Oct. 26, 1999

[54] EXERCISE MACHINE

[76] Inventor: George B. Shaw, 8071 E. Del Trigo, Scottsdale, Ariz. 85258

[21] Appl. No.: 08/760,674

[22] Filed: Dec. 4, 1996

[51] Int. Cl.[6] ..... A63B 23/02

[52] U.S. Cl. ..... 482/142; 482/95; 482/143; 482/907; 601/49

[58] Field of Search ..... 482/95, 96, 133, 482/134, 137, 139, 142, 144, 148; 601/49

[56] References Cited

U.S. PATENT DOCUMENTS

| | | | |
|---|---|---|---|
| 2,644,688 | 7/1953 | Roberge | 482/142 |
| 4,915,378 | 4/1990 | Abrahamian et al. | 482/142 |
| 5,042,800 | 8/1991 | Walter | 482/142 |

*Primary Examiner*—Richard J. Apley
*Assistant Examiner*—John Mulcahy
*Attorney, Agent, or Firm*—Halvorson & Venable, P.C.

[57] ABSTRACT

The present invention provides an exercise apparatus which utilizes gravity to create a gentle tension upon the lower back. This gentle tension is used in combination with stretching and toning exercises to strengthen and rehabilitate the lower back. The present invention further provides an attached vibratory device attached to the exercise apparatus. The attached vibratory device is used in conjunction with lower back exercises and stimulates the muscle tissue and blood circulation. The apparatus of the present invention comprise the primary structures: a body support structure, a leg support structure and a base connected to both the body support structure and the leg support structure. The apparatus of the present invention further provides for a multitude of different positions in which the therapeutic stretches and exercises may be performed.

12 Claims, 4 Drawing Sheets

EXERCISE MACHINE

FIELD OF THE INVENTION

The field of the present invention relates to an apparatus for stretching and exercising the body, and more particularly to a novel design for a back therapy machine which includes a vibratory attachment to aid lower back therapy.

BACKGROUND

A common complaint among individuals is lower back pain. Frequently, the pain results from poor lower back muscle tone or reduced blood circulation to the afflicted area of the body. Vibratory massage is one method currently used to alleviate lower back pain. Typically, a device for creating a vibratory sensation is placed inside of a chair or a cushion. The user then sits upon the chair or leans upon the cushion and turns on the vibratory device. For examples of such vibratory therapy devices see U.S. Pat. No.'s: 2,715,901; 3,678,923; 3,948,379; 4,006,739; 4,971,040 and 5,022,384. For the most part, vibratory therapy devices have been used as passive therapy systems.

More proactive back therapy systems have been devised and are found in the prior art. These devices fall in two classifications: first, systems which utilizes kinesthetics to reduce lower back pain; and second, systems in which the user actively stretches and exercises muscles, thus strengthening and improving muscle tone.

In the first classification, kinesthetic treatment, the proactive therapy system places the user into a work position which reduces any stress and strain upon the lower back. Kinesthetic devices are designed to be used during a workers normal work routine. They serve to reduce problems causing lower back pain and not treat and/or strengthen the muscles of the lower back. An example of a kinesthetic device is found in U.S. Pat. No. 5,487,590 by Haynes.

In the second classification, active exercising devices, body movement is coupled with body placement to perform muscle stretching and exercising. A first example of a back exercise apparatus is found in U.S. Pat. No. 5,070,863 by McArthur et al. which provides an exercise device with two separate rotation axes for back therapy. There is a first vertical axis, generally aligned with the users spine, about which the user twists and turns, and there is a second horizontal axis, perpendicular to the first axis, about which the user can perform back flexion and extension exercises. This device utilizes well known exercises to provide therapy for lower back pain.

A second example of a back therapy system is found in U.S. Pat. No. 5,217,487 by Engle et al. which provides a back therapy device which utilizes a pivotable pelvic support. The user lies on the pelvic support, either face-down or face-up, and performs stretches and exercises. The pelvic support is positioned primarily under the user's center of gravity. However, this device provides a foot rest that is used to stabilize the user when he displaces his center of gravity slightly.

There is a third example of a back therapy system, found in U.S. Pat. No. 5,496,247, by Anderson, which provides a bench type apparatus with a plurality of belts used to anchor the lower portion of the body into place. Once the lower body is anchored into place the lower back muscles are isolated and may be more efficiently exercised.

While the above examples of back therapy devices are useful, none of the known prior art teaches, nor suggests, a device which incorporates both the features and benefits of a passive vibratory system with the features and benefits of an active, exercise oriented, system. Nor does the above prior art provide a device which utilizes gravity to create a gentle tension on the lower back for improved stretching and exercise.

SUMMARY OF THE INVENTION

It is an object of the present invention to provide an exercise machine useful for conditioning the lower back.

It is another object of the present invention to provide an exercise machine which incorporates a vibratory device into an active exercise device.

It is a further object of the present invention to provide an exercise machine which utilizes tension to aid in the therapy of lower back pain.

It is yet another object of the present invention to provide an exercise machine wherein the user is suspended from the machine at a first fixed position near the shoulders, and at a second fixed position, near the knees, whereupon the force of gravity upon the body creates a tension between the two fixed points to gently stretch lower back muscles and provides relief to lower back pain.

It is still yet another object of the present invention to provide an exercise machine wherein the user is suspended from two fixed points, thus using gravity to create a gentle tension on the back, and includes a vibratory device to stimulate blood circulation and muscle tone.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
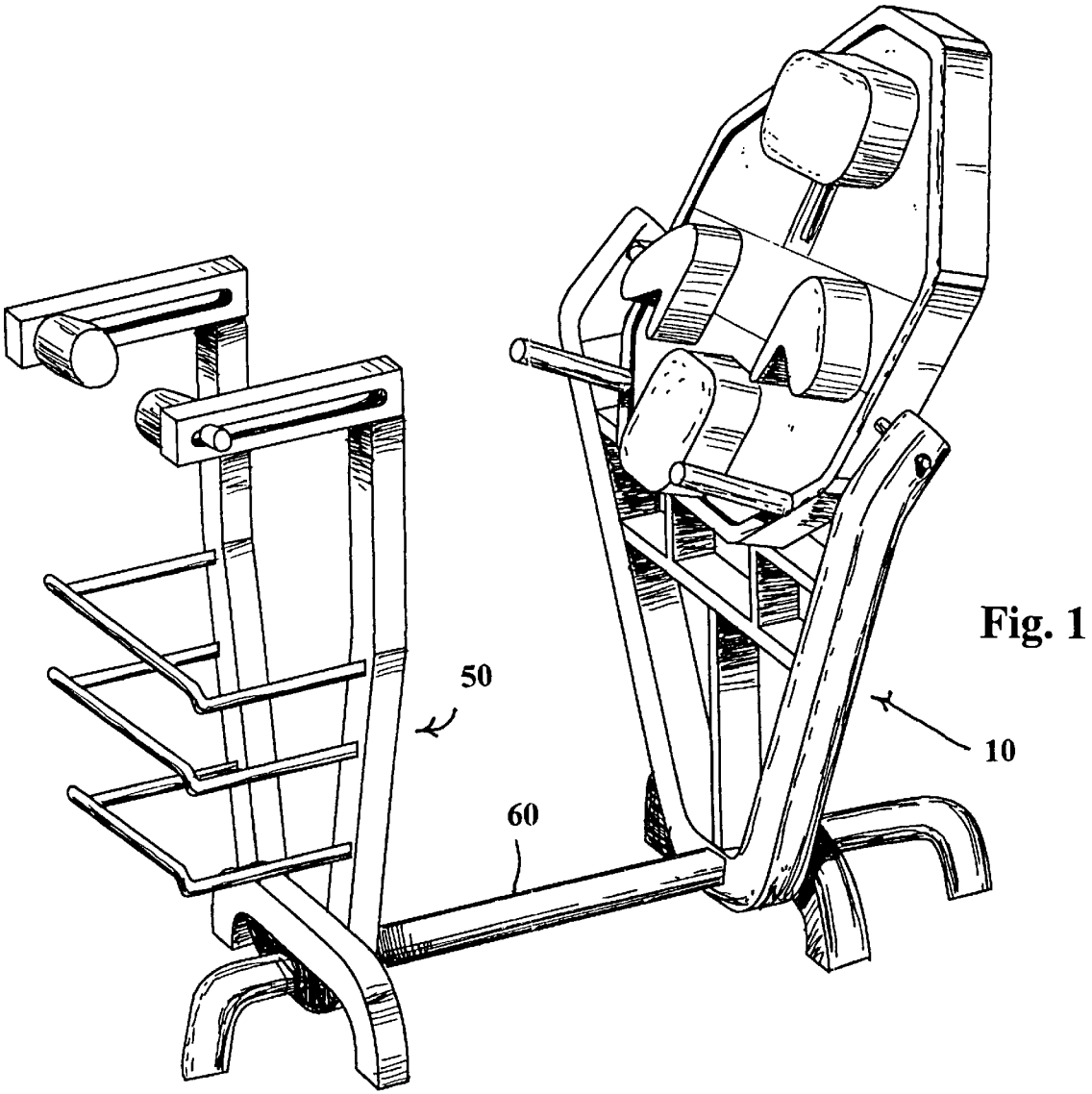
FIG. 1 is a perspective view of the present invention.
Figure 2:
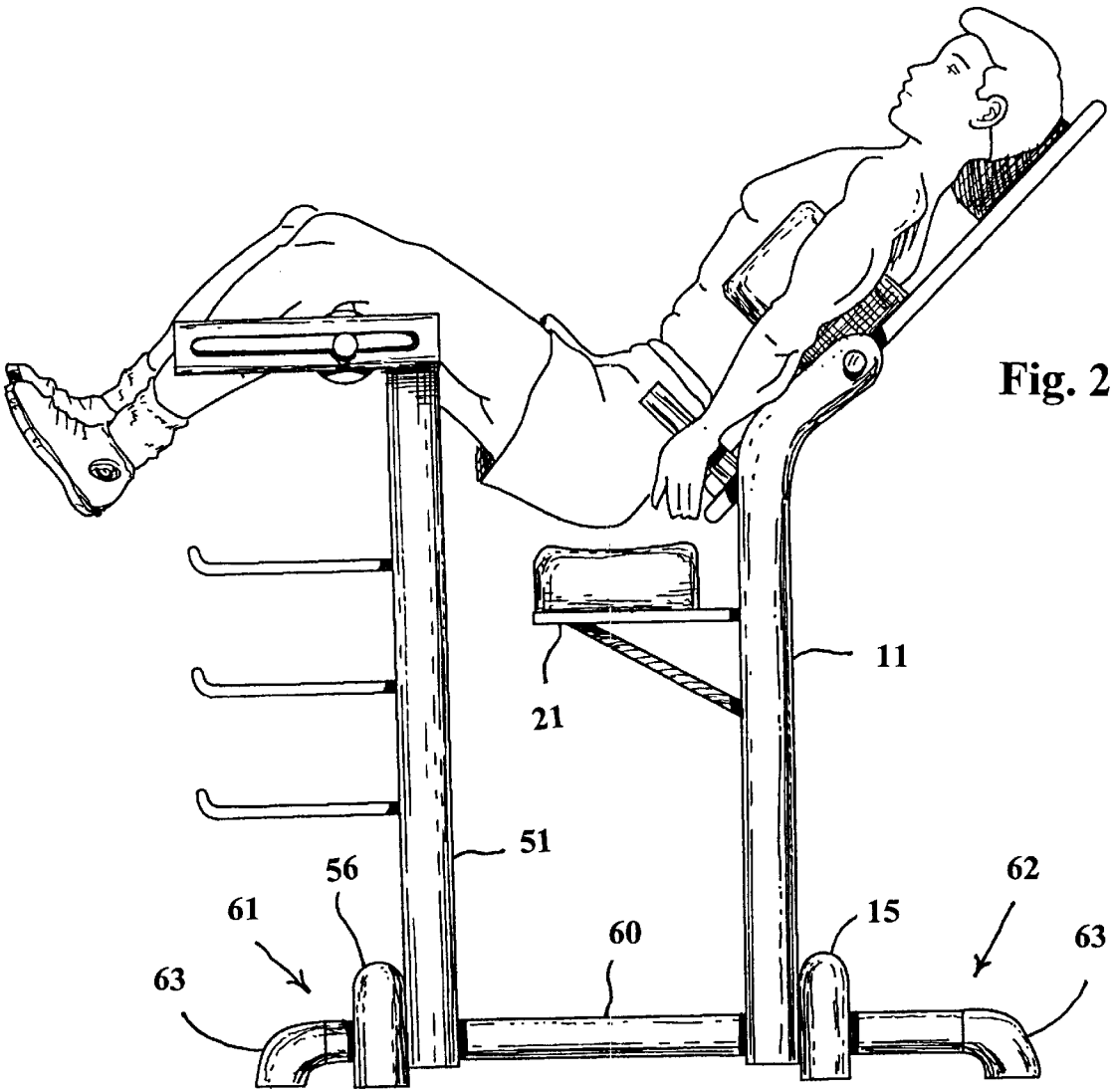
FIG. 2 illustrates, from a side view, how the present invention is used.
Figure 3:
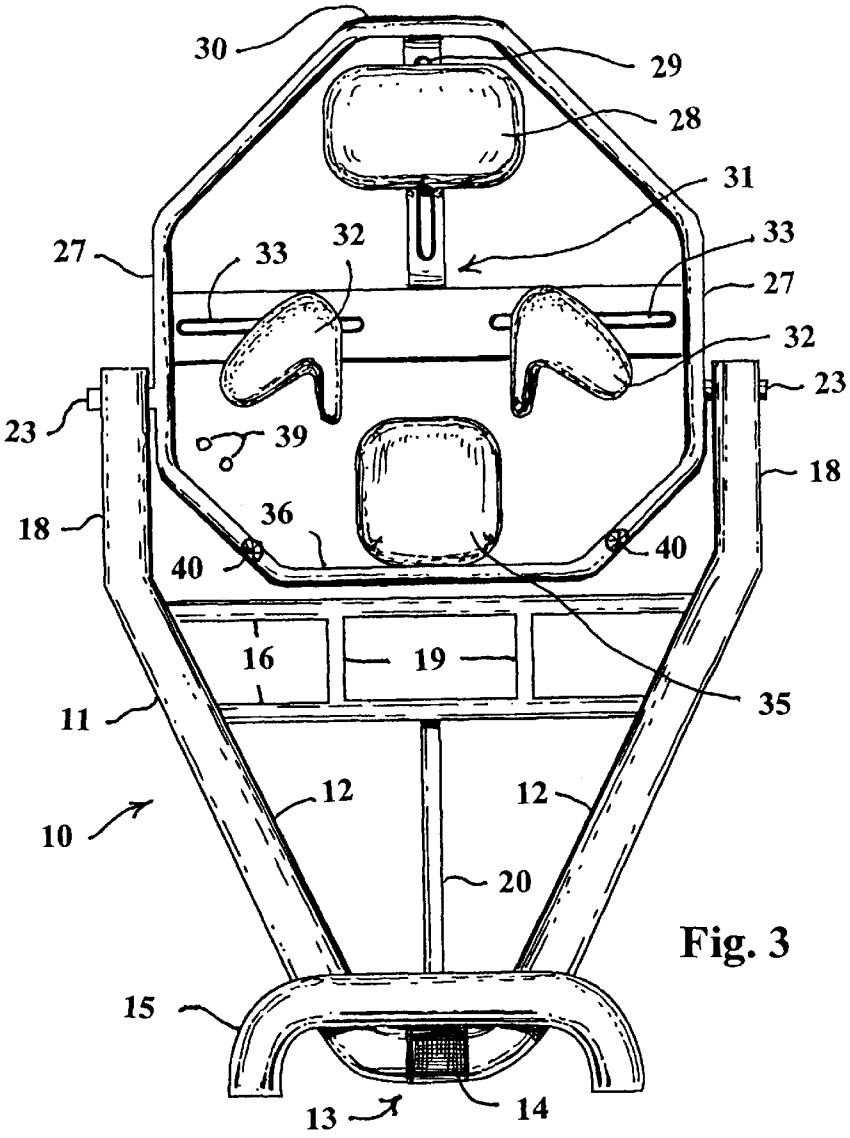
FIG. 3 shows a front view of the body support upright of the present invention.
Figure 4:
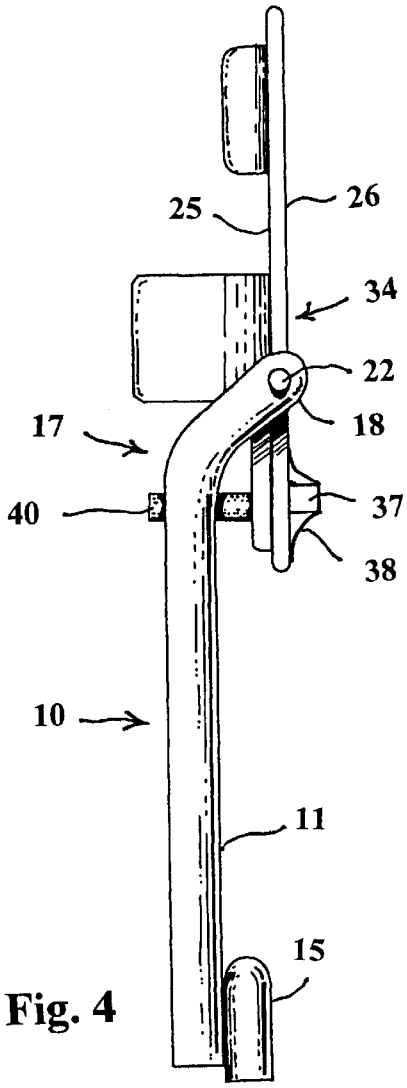
FIG. 4 shows a side view of the body support upright of the present invention.
Figure 5:
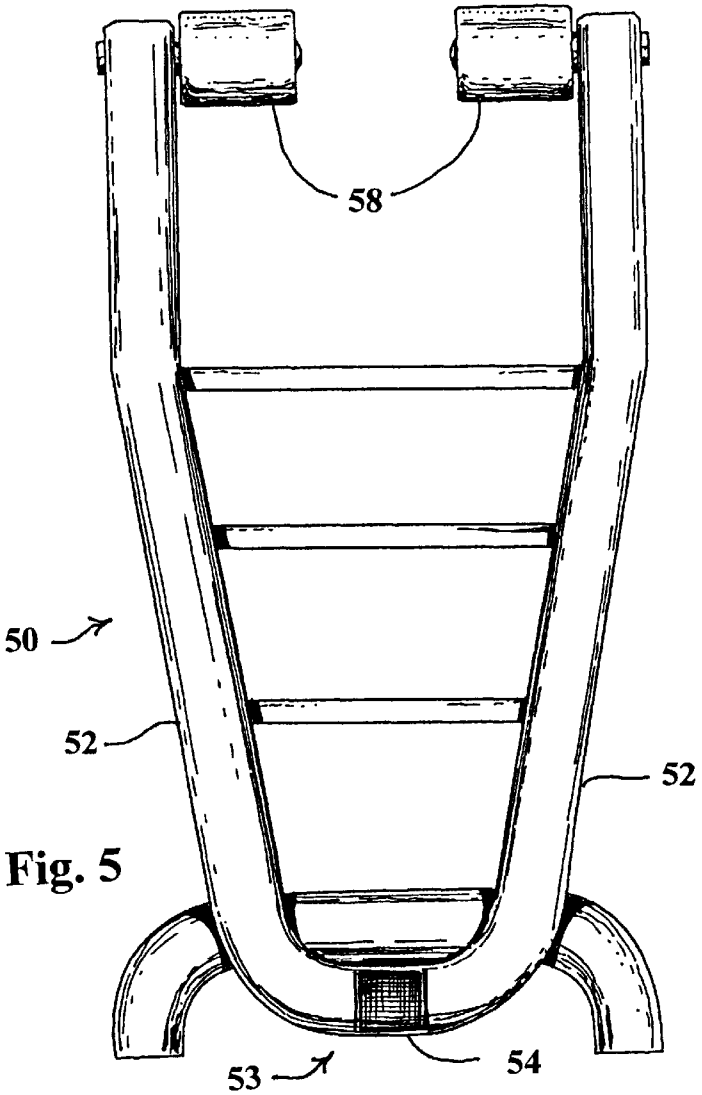
FIG. 5 shows a front view of the leg support upright of the present invention.
Figure 6:
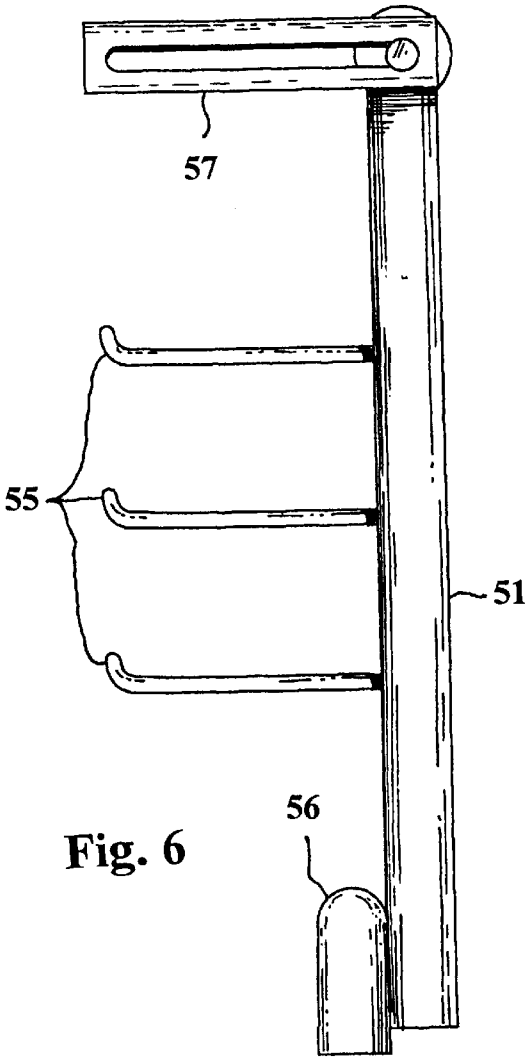
FIG. 6 shows a side view of the leg support upright of the present invention.

The present invention, shown in the figures, provides an exercise device which creates a gentle tension on a user's lower back by suspending the user from two fixed points. This tension upon the lower back is useful for reducing stress and strain upon the lower back during stretching and exercises. The present invention also provides a vibratory device to stimulate muscles and improves blood circulation. These features provide a device which is useful for lower back therapy.

The device of the present invention has three main components. A first component, the body support upright 10, has an upright section it which is produced from three inch round stock tubing. The tubing is formed in to a substantially V-shape, with two arms 12 converging together to a vertex 13. The vertex 13 of the V-shaped upright section 11 is located near the floor and has a three inch square aperture 14 running perpendicular to the plane of the V-shaped upright section 11. The function of the three inch square aperture 14 will become apparent later.

Attached to the V-shaped upright section 11, near the vertex 13 of the two arms 12 of the upright section 11, is a first lateral support member 15. The first lateral support member 15 is a substantially U-shaped piece of three inch round tubing stock. The U-shape of the first lateral support member 15 is oriented arms of the first lateral support member 15 pointing downward thus providing two points of contact with the floor. The first lateral support member 15 is attached to the upright section 11 by means well known in the art such as welding.

In the preferred embodiment there are two parallel substantially horizontal supports 16 attached between the two arms 12 of the upright section 11. The two horizontal supports 16 are located below an out of plane bend 17 formed by the canting distal ends 18 of the two arms 12 in a backward direction, out of the plane of the V-shape of the upright section 11. There are two equally spaced vertical supports 19 running between the two horizontal supports 16, adding vertical stability. There is a final vertical support 20 extending between the lower of the two horizontal supports 16 and the vertex 13 of the V-shaped upright section 11.

Attached to the final vertical support 20 is a seat member 21. The seat member 21 projects in the forward direction from the V-shaped upright section 11 and can be repositioned in the vertical direction on the final vertical support 20. The seat member 21, preferably, is padded and upholstered. The seat member 21 should be adjustable from twenty two inches in height to twenty eight inches in height.

Each of the distal ends 18 of the arms 12 of the V-shaped upright section 11 has a pivot aperture 22 adapted to receive a pivot shank 23. The pivot aperture 22 has a horizontal attitude and has an axis located parallel to the plane of the V-shaped upright section 11. Preferably, the pivot apertures 22 also contain bearings to provide a smooth pivotal rotation.

The body support upright 10 also includes a pivotally attached body board 24. The body board 24 has a front surface 25 and a back surface 26. There are also multiple side surfaces forming a perimeter to the body board 24. Preferably, there are two side surfaces 27 which run perpendicular to the plane of the V-shape of the upright section 11. Attached to these two side surfaces 27 are the pivot shanks 23, one per side surface 27. The two pivot shanks 23 are coaxial and sized to be received by the pivot apertures 22 located on the distal ends 18 of the arms 12 of the V-shaped upright section 11. It is contemplated that the pivot range of the body board 24 should never reach a full vertical position.

The body board 24 has a head rest 28 moveably connected to the front surface 25 of the body board 24. The headrest 28 is received in a first channel 29 in the body board 24 which runs from near a top side 30 to approximately a mid-point 31 of the body board 24. The headrest 28 is capable of being secured to a single position during use. The headrest 28 should be padded and upholstered.

The body board 24 also has a pair of movable armrests 32 The armrests 32 are capable of being moved from points near the side surfaces 27 of the body board 24 toward a middle line of the body board 24. The armrests 32 are shaped to be received in an armpit area of the user's body, and are preferably padded and upholstered. There should be a minimum of twelve inches separation between the armrests 32, adjustable to a maximum of twenty three inches of separation, to accommodate any size of individual. Located on the back surface 26 of the body board 24, near adjustment channels 33 for the armrests, are position scales 34. The position scales 34 allow a user to quickly and accurately reposition the armrests to a known and desired position.

The body board 24 further contains an attached vibratory device 35 located on the front surface 25, near a bottom side 36 of the body board 24. The vibratory device 35 is padded and upholstered. The vibratory device 35 has a motor 37 which is attached by metal straps 38 to the back surface 26 of the body board 24. The motor 37 is preferably exposed for more efficient ventilation and cooling. There are two controls 39 located on the body board 24, with in easy reach of a user's hands, for controlling the vibratory device 35. One switch is a time controller, while the other switch is a vibration speed controller.

Finally, there are hand grips 40 attached to the front surface 25 of the body board 24 near the bottom side 36. The hand grips 40 are used to help support the weight of the user's body.

There is a second component, the leg support upright 50. The leg support upright 50 has a V-shaped second upright section 51 with two arms 52 converging together to a vertex 53, said V-shaped second upright section 51 is made from three inch round tubing stock. The vertex 53 of the V-shaped second upright section 51 is located near the floor and also has a second three inch square aperture 54 running perpendicular to the plane of the V-shaped second upright section 51.

There are at least three foot rungs 55 attached between the two arms 52 of the V-shaped second upright section 51. The foot rungs 55 project from the plane of the V-shape of the second upright section 51 in the forward direction. The three foot rungs 55 should be positioned 16 inches, 23 inches, and 30 inches from the floor.

Attached to the V-shaped second upright section 51, near the vertex 53 of the two arms 52 of the second upright section 51, is a second lateral support member 56. The second lateral support member 56 is a substantially U-shaped piece of three inch round tubing stock. The U-shape is oriented with arms of the U-shape pointing downward thus providing two points of contact with the floor. The second lateral support member 56 is attached to the second upright section 51 by means well known in the art such as welding.

Attached to each of the two arms 52 of the V-shaped second upright section 51 is a horizontal leg support runner 57. The horizontal leg support runners 57 receives movable leg supports 58 which are cylindrical padded members projecting from the horizontal leg support runners 57 inward, toward a mid-line of the second upright section 51. The leg supports 58 are held in position on the horizontal leg support runners 57 by frictive forces. The horizontal leg support runners 57 should be sized to allow for twelve inches of adjustment.

There is a third component and final component, the horizontal base 60. The horizontal base 60 is a piece of three inch square tubing stock with a first end 61 and a second end 62. Attached to the first end 61 and second end 62 of the horizontal base are base end caps 63. The base end caps 63 are arcuate structures which curve and extend from respective ends 61 and 62 of the horizontal base 60 to the floor.

In use, the body support upright 10 and the leg support upright 50 are placed in a vertical position. The horizontal base 60 is directed through the square apertures 14 and 54 in both the body support upright 10 and the leg support upright 50. Then base end caps 63 are placed upon the first end 61 and second end 62 of the horizontal base 60. The body support upright 10 and the leg support uprights 50 are located near opposite ends of the horizontal base 60 and secured into place by means of a set screw as is well known in the art.

The user will use the device by first sitting upon the seat member 21. The user places the movable armrests 32 underneath the arm pit region of the body. The user then walks his feet up the foot rungs 55 and places his knees onto the leg supports 58. This will place the user into a position where the user's rear end is not in contact with the seat member 21. By suspending from the device at these two fixed points, the user utilizes the force of gravity to create a gentle tension upon the lower back region encouraging a variety of twisting and turning stretches and exercises. The user may perform these exercises in a variety of different attitudes by merely fixing the back board 24 into a different pivotal orientation. The head rest 28 is adjusted to be placed behind the head of the user while the device is in use The armrests 32 are adjusted to bunder the arm placed under the arm pit area of the body. If desired, the user may also grasp the hand grips 40 and support a portion of the body weight upon the hand and arms.

While doing the above referred to stretches and exercises, the user may take advantage of the benefits of a vibratory massage by activating the included vibratory device. The device may be activated for a set amount of time, via the timer control, or may be adjusted to provide for differing frequencies of vibrations.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein are intended to be illustrative only and is not intended to be limitative. Rather, the scope of the invention described herein is limited only by the claims appended hereto.

What is claimed is:

1. An exercise machine comprising:

a body support upright;

a leg support;

a substantially horizontal base which is adapted to attach to both the body support upright and the leg support upright, respectively;

wherein the body support upright further comprises:

A) an upright section;

B) a first lateral support member attached to the upright section; and

C) a body board pivotally attached to the upright section;

and the upright section further comprises:

A) two arms converging together at a vertex to form a substantially V-shape, said two arms having distal ends which are canted out of the plane of the V-shape;

B) a square aperture located at the vertex of the upright section, said square aperture adapted to receive the horizontal base;

C) a horizontal pivot aperture located in each of the distal ends of said two arms, said horizontal pivot aperture being substantially parallel to the plane of the V-shaped upright section;

D) two parallel, substantially horizontal supports attached between the two arms of the upright section;

E) two equally spaced vertical supports running between the two horizontal supports;

F) a final vertical support extending between the lower of the two horizontal supports and the vertex of the upright section; and G) a seat member attached to the upright section.

2. An exercise machine as in claim 1 wherein the first lateral support member further comprising a substantially U-shape, with arms of the U-shape pointed downward.

3. An exercise machine as in claim 1 wherein the body board further comprises A) a front surface, a back surface and at least two side surfaces, a top surface and a bottom surface; wherein B) two pivot shanks attached to the two side surface, one on each side surface, respectively;

C) a head rest, located on the front surface, received in a first vertical channel in the body board;

D) a pair of movable armrests, located on the front surface, received in a pair of horizontal channels in the body board;

E) scales located on the back surface of the body board near the horizontal channels for the armrests, wherein the scales may be used to accurately reposition the pair of armrests;

F) an attached vibratory device located near a bottom side of the body board, and having a motor attached to the back surface of the body board, and having two controls located on the front surface of the body board, one for controlling vibration speed and the other for controlling duration of vibration; and G) hand grips attached to the front surface of the body board.

4. An exercise device as in claim 1 wherein the leg support upright further comprises A) a second, substantially V-shaped upright section comprising i) two arms converging together at a vertex to form a substantially V-shape;

ii) a second square aperture located at the vertex of the second upright section, said second square aperture adapted to receive the horizontal base;

iii) a plurality of foot rungs attached between the two arms of the second upright section;

iv) two horizontal leg support runners, one attached to distal ends of each of the two arms of the second upright section, respectively;

v) a leg support movably attached to each of the two horizontal leg support runners, respectively; and B) a second lateral support member attached to the second substantially V-shaped upright section.

5. An exercise device as in claim 4 wherein the second lateral support member further comprising a substantially U-shape, with arms of the U-shape pointed downward.

6. An exercise machine comprising:

A) a body support upright with:

i) an upright section;

ii) a first lateral support member attached to the upright section; and iii) a body board pivotally attached to the upright section;

B) a leg support with:

i) a second upright section; and ii) a second lateral support member attached to the upright section;

C) a base, wherein the base is attached to the body support upright and the leg support upright at opposite ends thereof;

wherein the upright section of the body support upright further comprises:

A) two arms converging together at a vertex to form a substantially V-shape, said two arms having distal ends which are canted out of the plane of the V-shape;

B) a square aperture located at the vertex of the upright section, said square aperture adapted to receive the base;

C) a horizontal pivot aperture located in each of the distal ends of said two arms, said horizontal pivot aperture being substantially parallel to the plane of the V-shaped upright section;

D) two parallel, substantially horizontal supports attached between the two arms of the upright section;

E) two equally spaced vertical supports running between the two horizontal supports;

F) a final vertical support extending between the lower of the two horizontal supports and the vertex of the upright section; and G) a seat member attached to the upright section.

7. An exercise machine as in claim 6 wherein the first lateral support member attached to the upright section of the body support upright further comprises a substantially U-shape, with arms of the U-shape pointed downward.

8. An exercise machine as in claim 6 wherein the body board further comprises A) a front surface, a back surface and at least two side surfaces, a top surface and a bottom surface; wherein B) two pivot shanks attached to the two side surface, one on each side surface, respectively;

C) a head rest, located on the front surface, received in a first vertical channel in the body board;

D) a pair of movable armrests, located on the front surface, received in a pair of horizontal channels in the body board;

E) scales located on the back surface of the body board near the horizontal channels for the armrests, wherein the scales may be used to accurately reposition the pair of armrests;

F) an attached vibratory device located near a bottom side of the body board, and having a motor attached to the back surface of the body board, and having two controls located on the front surface of the body board, one for controlling vibration speed and the other for controlling duration of vibration; and G) hand grips attached to the front surface of the body board.

9. An exercise machine as in claim 6 wherein the second upright section further comprises A) a second, substantially V-shaped upright section comprising i) two arms converging together at a vertex to form a substantially V-shape;

ii) a second square aperture located at the vertex of the second upright section, said second square aperture adapted to receive the horizontal base;

iii) a plurality of foot rungs attached between the two arms of the second upright section;

iv) two horizontal leg support runners, one attached to distal ends of each of the two arms of the second upright section, respectively; and v) a leg support movably attached to each of the two horizontal leg support runners, respectively; and B) a second lateral support member attached to the second substantially V-shaped upright section.

10. An exercise machine as in claim 6 wherein the second lateral support member attached to the second upright section of the leg support upright further comprises a substantially U-shape, with arms of the U-shape pointed downward.

11. An exercise machine as in claim 6 where in the base is a horizontal base made from square tubing.

12. An exercise machine comprising:

A) a body support upright with;

i) an upright section with;

a) two arms converging together at a vertex to form a substantially V-shape;

b) a square aperture located at the vertex of the upright section;

c) said two arms having distal ends which are canted out of the plane of the V-shape;

d) each of the distal ends of said two arms further having a horizontal pivot aperture substantially parallel to the plane of the V-shaped upright section;

e) two parallel substantially horizontal supports attached between the two arms of the upright section;

f) two equally spaced vertical supports running between the two horizontal supports;

g) a final vertical support extending between the lower of the two horizontal supports and the vertex of the upright section;

h) a seat member attached to the upright section;

ii) a first lateral support member attached to the upright section wherein the first lateral support member attached to the upright section of the body support upright further comprises a substantially U-shape, with arms of the U-shape pointed downward; and iii) a body board pivotally attached to the upright section having a) a front surface, a back surface and at least two side surfaces, a top surface and a bottom surface; wherein b) two pivot shanks attached to the two side surface, one on each side surface, respectively;

c) a head rest, located on the front surface, received in a first vertical channel in the body board;

d) a pair of movable armrests, located on the front surface, received in a pair of horizontal channels in the body board;

e) scales located on the back surface of the body board near the horizontal channels for the armrests, wherein the scales may be used to accurately reposition the pair of armrests;

f) an attached vibratory device located near a bottom side of the body board, and having a motor attached to the back surface of the body board, and having two controls located on the front surface of the body board, one for controlling vibration speed and the other for controlling duration of vibration; and g) hand grips attached to the front surface of the body board;

B) a leg support upright with i) a second upright section having a) a second, substantially V-shaped upright section with two arms converging together at a vertex to form a substantially V-shape;

b) a second square aperture located at the vertex of the second upright section;

c) a plurality of foot rungs attached between the two arms of the second upright section;

d) two horizontal leg support runners, one attached to distal ends of each of the two arms of the second upright section, respectively;

e) a leg support movably attached to each of the two horizontal leg support runners, respectively; and ii) a second lateral support member attached to the second upright section, wherein the second lateral support member attached to the second upright section of the leg support upright further comprises a substantially U-shape, with arms of the U-shape pointed downward; and C) a base, wherein the base is attached to the body support upright and the leg support upright by receiving opposite ends of the base through the square aperture located at the vertex of the upright section and the second square aperture located at the vertex of the second upright section, respectively.

* * * * *